US006125971A

United States Patent [19]

Niebuhr et al.

[11] Patent Number: 6,125,971

[45] Date of Patent: Oct. 3, 2000

[54] FORKLIFT TRUCK

[75] Inventors: Michael Niebuhr, Bargteheide; Hans-Peter Schmohl, Hamburg; Heinz Schalmath, Stuvenborn, all of Germany

[73] Assignee: Jungheinrich Aktiengesellschaft, Hamburg, Germany

[21] Appl. No.: 09/029,183

[22] PCT Filed: Mar. 1, 1996

[86] PCT No.: PCT/EP96/00864

§ 371 Date: Apr. 27, 1998

§ 102(e) Date: Apr. 27, 1998

[87] PCT Pub. No.: WO97/10170

PCT Pub. Date: Mar. 20, 1997

[30] Foreign Application Priority Data

Sep. 13, 1995 [DE] Germany ..... 295 14 676

[51] Int. Cl.[7] ..... B66F 9/06

[52] U.S. Cl. ..... 187/231; 187/222; 187/414; 40/514; 40/299.01; D34/34

[58] Field of Search ..... 187/222, 226, 187/227, 231, 414; 180/19.1, 213, 214; 40/513, 514, 517, 308, 299.01; D34/34

[56] References Cited

U.S. PATENT DOCUMENTS

| | | | |
|---|---|---|---|
| D. 222,670 | 11/1971 | Goodacre et al. | D34/34 |
| D. 239,165 | 3/1976 | Mono | D34/34 |
| D. 262,613 | 1/1982 | Frees | D34/34 |
| D. 343,935 | 2/1994 | Drobeck et al. | D34/34 X |
| D. 348,759 | 7/1994 | Bhambra | D34/34 |
| D. 386,876 | 11/1997 | Niebuhr | D34/34 |
| 2,399,632 | 5/1946 | Guerin | 187/226 |
| 2,592,091 | 4/1952 | Weaver | 180/214 |
| 2,643,740 | 6/1953 | Quayle | 187/231 |
| 2,840,175 | 6/1958 | Ulinski | 180/19.1 |
| 3,068,019 | 12/1962 | Ulinski | 180/19.1 |
| 3,187,829 | 6/1965 | Ulinski | 180/19.1 |
| 3,202,233 | 8/1965 | Dolphin et al. | 187/231 |
| 3,430,374 | 3/1969 | Woodard | 40/514 |
| 4,615,533 | 10/1986 | Sewell | 280/43.12 |
| 5,097,611 | 3/1992 | Smollar et al. | 40/514 |
| 5,438,780 | 8/1995 | Winner | 40/514 |
| 5,501,297 | 3/1996 | Josephs | 187/222 |

FOREIGN PATENT DOCUMENTS

| | | | |
|---|---|---|---|
| 2536564 | 5/1984 | France | 40/308 |
| 1174176 | 7/1964 | Germany | 187/231 |

OTHER PUBLICATIONS

Big Joe Hydraulic Lift Trucks, Big Joe Mfg Co. catalog (4 pages), May 1953.

Walkie Type Trucks, Moto–Truc Co. catalog (6 pages), May 1953.

*Primary Examiner*—Robert P. Olszewski
*Assistant Examiner*—Thuy V. Tran
*Attorney, Agent, or Firm*—Vidas, Arrett & Steinkraus, P.A.

[57] ABSTRACT

A forklift truck which includes a chassis (10) and a housing (12). Two parallel spaced wheel arms are attached to the chassis. The housing includes a battery-operated driving motor as well as a hydraulic lift. A pole (16) including control means for the control of said motor and said hydraulic lift is connected to a stand (203), the stand being rotatably mounted about a vertical axis and connected to a driving wheel (202). A monomast (20) is arranged centrally between the wheel arms and integral with the housing, the monomast have front and back sides, the back side facing the pole. A carriage (22) for a load fork is attached to the hydraulic lift. A box-shaped cover is attached to the back side of the monomast, and the pole is arranged asymmetrically with respect to the monomast.

3 Claims, 14 Drawing Sheets

FORKLIFT TRUCK

BACKGROUND OF THE INVENTION

Smaller-sized industrial trucks including a forklift function mostly are constructed as motor-driven trucks to be accompanied and are guided and operated by means of a shaft. The shaft is connected to the driving means and directly actuates the driving wheel, above which a battery-operated electric motor is provided. It is known to arrange the shaft and the driving motor on one side asymmetrically. In the housing of the driving means, furthermore, the battery and a hydraulic aggregate are provided for actuating the lift cylinder. The lift cylinder is a component part of a lifting means onto which a carriage is guided at variable height. The lifting means usually is composed of two spaced mast channel members which are arranged in front of the driving means and are supported by the wheel arms connected to said driving means. The lift carriage comprises guiding rollers on opposite sides which guiding rollers are guided within the mast channel members being U-shaped in cross-section. The lift carriage forms a whole with the carrying tines of the cargo fork which, up to but excluding the wheel arms, are capable of descending, with the cargo fork being covered.

It is the object of the invention to provide a forklift truck which, at the same time, can be used as advertising medium.

SUMMARY OF THE INVENTION

The invention is based upon the knowledge that the mast is suitable for providing it with planiform or relief-like coverings which do neither impair the function of the forklift truck nor its operation. The advertising media, for instance, may be a covering or a plate which covers at least part of the lifting means.

In a preferred embodiment of the invention provision is made for said advertising media to be arranged on a single lift mast centrally provided between the wheel arms, preferably as a facing of the so-called monomast on the rear side above the housing of the driving means.

According to a development of the invention, the lift mast or monomast, preferably, is integrated into the housing of the chassis and only slightly projects from the outer contour. The projecting end only needs to be selected at a size which prevents the cargo carriage from getting into touch with the chassis. By this, the monomast can be most effectively and solidly connected to the chassis so as to absorb the moment caused by the cargo carriage and, especially, by the cargo.

In spite of the solid arrangement of the monomast in the chassis the interior space of the housing is not unnecessarily confined. On the contrary, there still is available a continuous space for the accommodation of a battery and the various aggregates.

According to a further development of the invention, the covering, preferably, is box-shaped. The covering prevents the operator from reaching inside the mast and injuring himself. Besides, a corresponding optical design gives the forklift truck an attractive look. Preferably, the covering is made of synthetic material and, therefore, may be shaped in any way whatever. It may show different objects by means of a corresponding embossing or design which allows the lifting means to be used as advertising surface or advertising medium at the same time.

Preferably, the covering is adapted to be attached detachably, and, for instance, may be clipped into the lift mast. Thus, there may be used a covering selected according to the user and serving his advertising purposes. Besides, the covering may comprise one or several openings for the accommodation of objects or different functional inserts. So, for instance, it is thinkable to use the covering for the accommodation of a control- and/or display module. If there are concerned any shaft-guided forklift trucks the actuation of the truck is made with the aid of any actuating element provided within the shaft head. Sometimes, however, it is also desirable to integrate any additional displays and operating elements which, according to the invention, may be arranged within the covering. Alternatively, a functional insert may be provided for the accommodation of writing implements or any other things being necessary for the operator. It is also thinkable to install in the covering a telephone set. Furthermore, it is thinkable to integrate into the covering a radio receiver or a cassette recorder or a coin collector for renting purposes.

Any conventional forklift trucks comprise a lifting means including two laterally spaced mast sections guiding the cargo carriage. The operator can look through the space between the mast sections and thus have a good view of the material to be handled. Even such a lifting means is suitable for providing any planiform or relief-like space for promotional purposes. So the mast sections may be provided with coverings at the side, the width of which, preferably, is larger than that being necessary for the mast sections. Preferably, the coverings become larger from top downwardly. Besides, a further covering may be provided between the mast sections in the upper area, which covering also may extend between the upper ends of the mast sections. Alternatively or additionally, an advertising medium may cover the space between the mast sections on the side of the driving means. For this purpose, any transparent material, for instance a transparent foil or a transparent plate, may be put between the upper ends of the mast sections and the housing of the driving means. Alternatively, a meshed or latticed material may be provided, too.

Finally, a nontransparent material may cover the space between the mast sections as well. Since, in this case, the view of the operator of the forklift truck is obstructed, precautions need to be taken for removing this material. For doing so, it may be defined as a jalousie or a window blind so as to provide a sufficient view for the operator by choice.

BRIEF DESCRIPTION OF THE DRAWINGS

The invention will be more detailedly explained hereinafter with the aid of drawings.

DETAILED DESCRIPTION OF THE INVENTION

Figure 1:
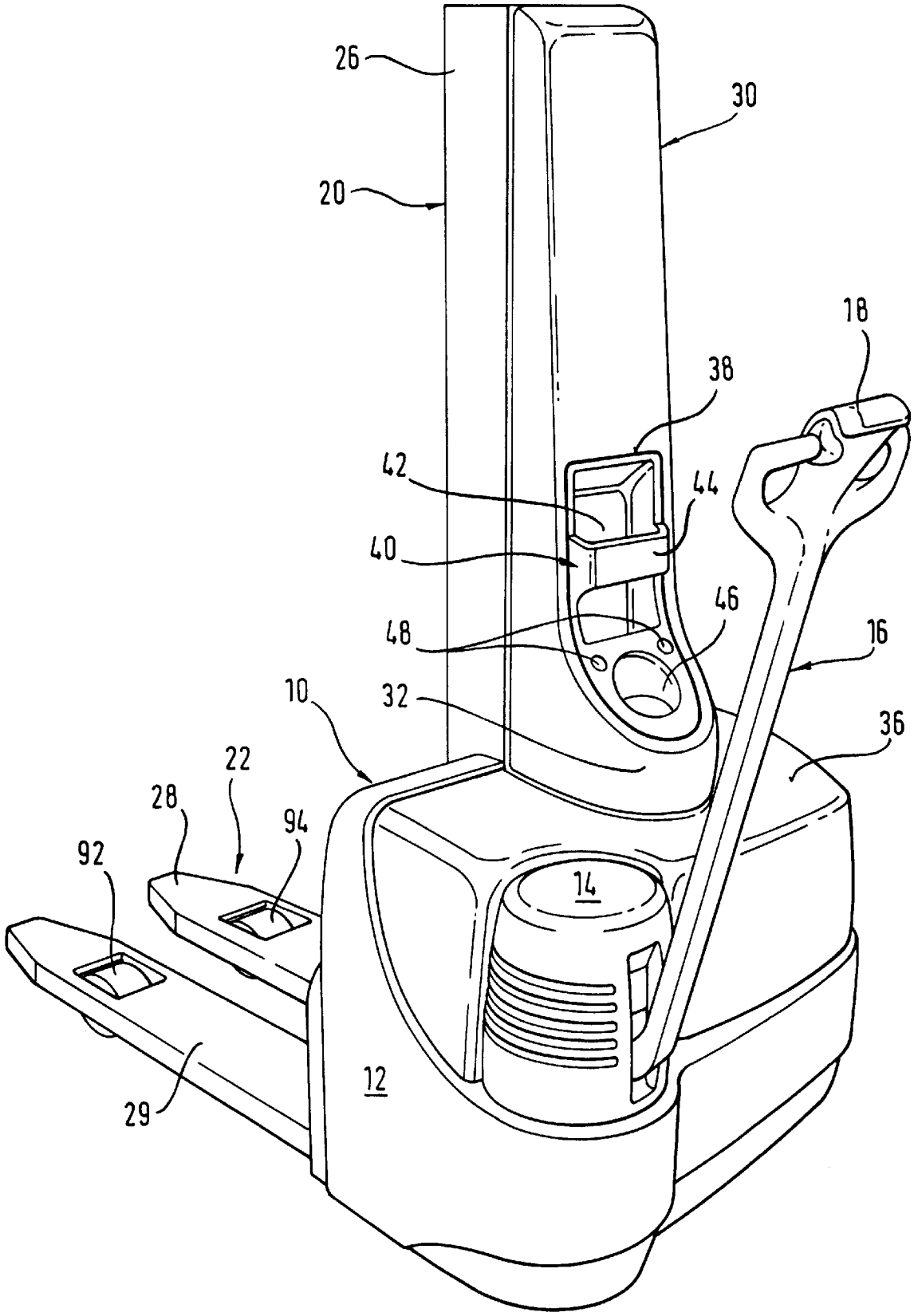
FIG. 1 perspectively shows a forklift truck according to the invention obliquely from behind.
Figure 2:
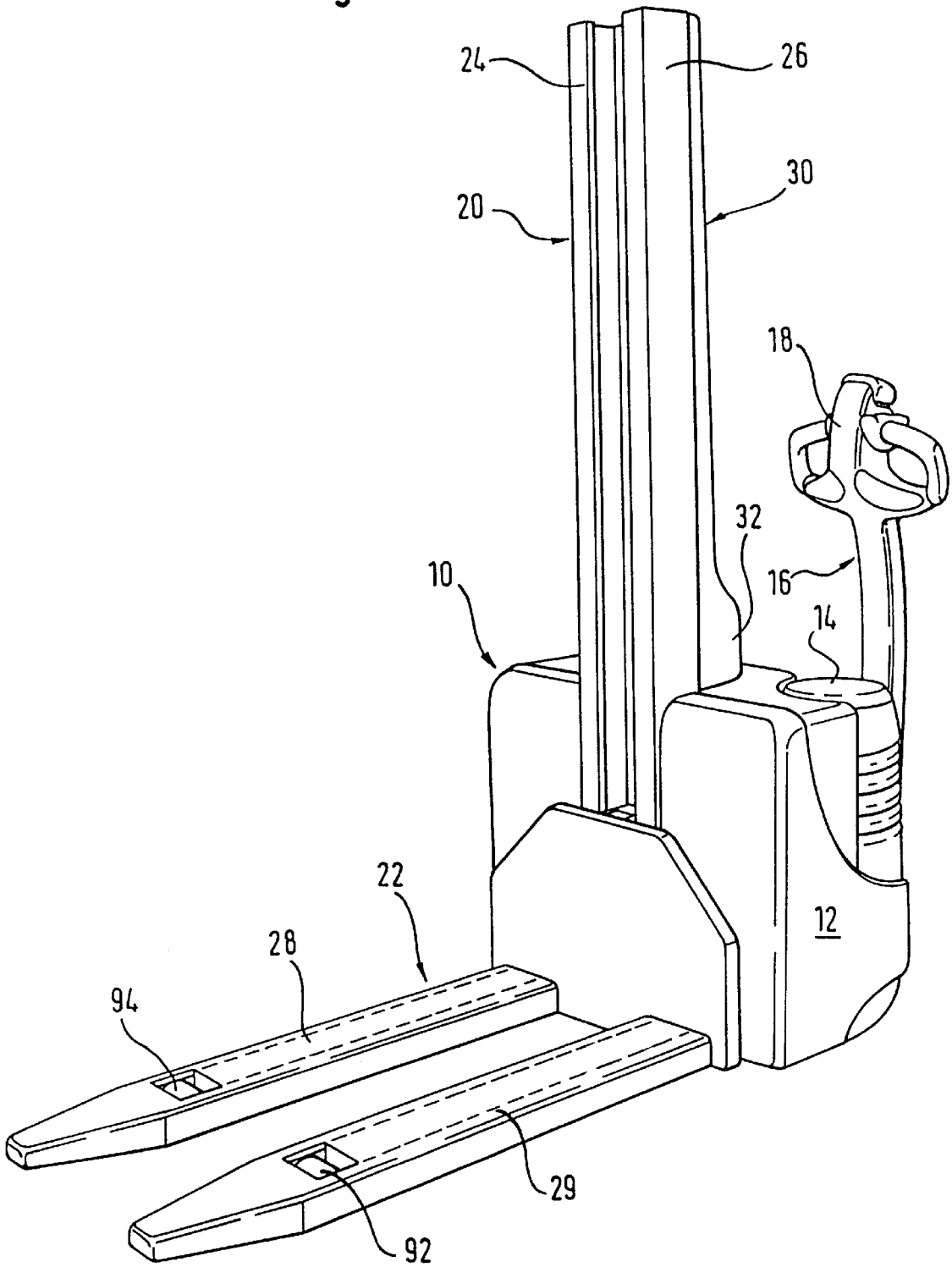
FIG. 2 perspectively shows the forklift truck according to FIG. 1 obliquely from front.

The forklift truck according to FIGS. 1 and 2 comprises a chassis 10 including a housing 12. On the rear side of the chassis the driving motor for the driving wheel beneath the motor—not shown—is arranged at a corner of a housing 14. The battery for driving the motor is provided within the housing 12 and is not visible. Motor and driving wheel are arranged on a stand mounted rotatably about a vertical axis, which stand is coupled to a shaft 16 comprising a shaft head 18 having gripping portions and functional elements for driving the motor as well as a lift aggregate within the housing 12. A recess of said housing 12 receives a so-called monomast 20 which defines the lifting means for a cargo carriage 22. The monomast only slightly projects from the outer contour at the side, as seen from FIG. 2 particularly. The monomast 20 is composed of two mast channel members 24, 26 formed U-shaped in cross-section which are arranged between the carrying arms 28, 29 or the underlying wheel arms which, however, are not visible in FIGS. 1 and 2. The mast channel members 24, 26 are arranged close to one another so as to still leave a clear spacing to the adjacent wheel arms. The side of the monomast 20 facing the shaft 16 is covered by a box-type covering 30, the longitudinal surface plane of which broadens downwardly, as shown at 32. Broadening is made with an easy bend. Section 32 is rounded in the lower portion. It rests on an approximately flat upper surface 36 of the housing 12 of the chassis 10. The covering 30 is detachably connected to the monomast 20 in a way not shown, for instance by clipping it into the latter, and may be replaced by a differently shaped covering. In the covering which is formed of a synthetic material an opening 38 is provided which in the upper area is rectangular and in the lower area (section 32) is rounded. It receives the insert 40 including an upper compartment 42 which is confined by a bow-shaped section 44 and allows any elongated objects to be inserted from above and be kept there. In the lower area a round accommodation hole 46 is provided, for instance for the accommodation of a bottle or suchlike. Smaller openings 48 on both sides of the bigger opening 46, for example, serve the accommodation of any writing utensils.

As can be seen, the monomast being very narrow in transverse direction allows a good view forwardly if the shaft 16 is arranged asymmetrically, i.e. towards one side.

It still needs to be added that the covering 30 or 30*a* to 30*f* can also be provided with an advertising print or with a relief-like embossing or shaping which, for example, shows or describes any specific objects for which promotion is made, for instance.

FIG. 3 shows different embodiments of the lower portion of the covering 30 for the mast 20 according to FIGS. 1 and 2. In FIG. 3*a* an insert 100 is inserted into the opening 38 of the covering 30*a* which, comprising corresponding control knobs and a display 102, is used as an additional display- and control module. In FIG. 3*b* a functional module 104 is inserted into the opening 38 of the covering 30*b* which, comprising a means 106 for keeping a pad or suchlike and bigger and smaller openings 108 for the accommodation of writing utensils or suchlike, may serve as a so-called write module.

Figure 3A:
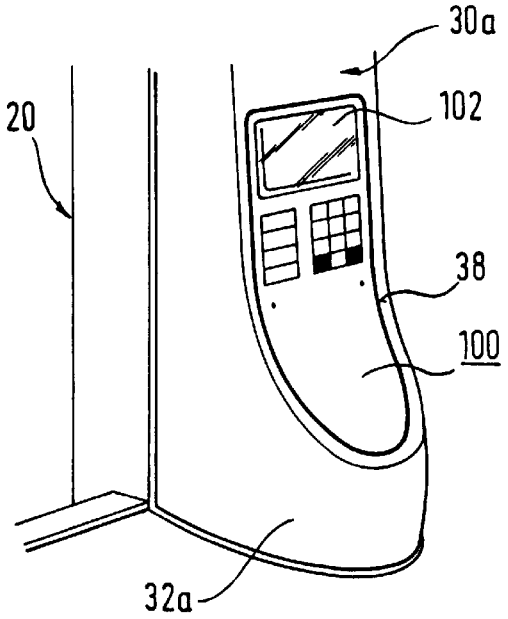
FIGS. 3*a* to *f* perspectively show different embodiments of the covering of the lift mast of the forklift truck according to FIGS. 1 and 2.
Figure 3B:
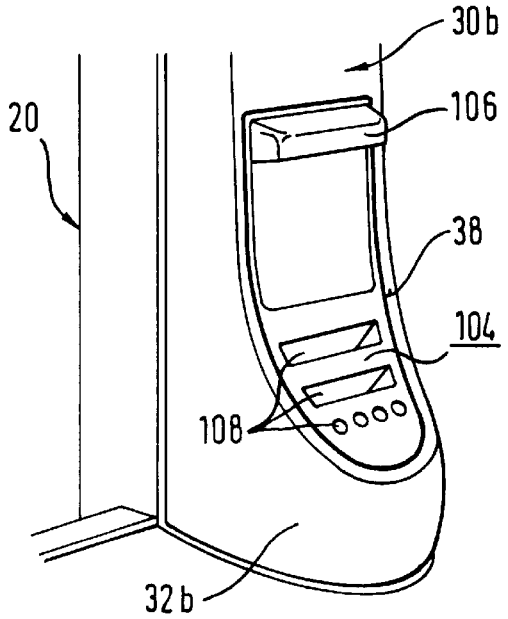
Figure 3C:
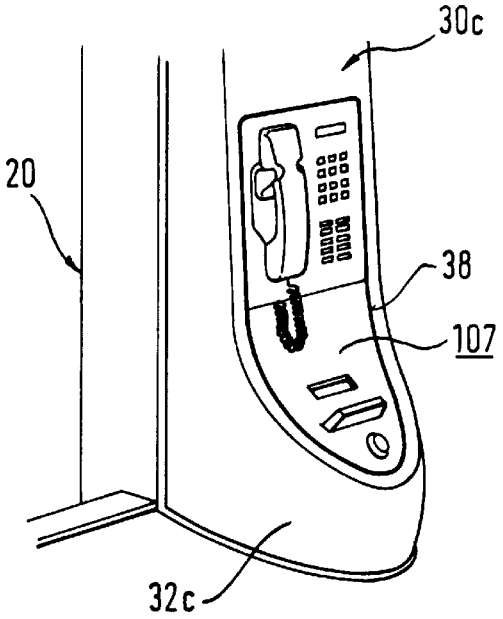

In FIG. 3*c* a telephone, eventually a pay or card phone, is inserted into the opening 38 as a functional unit 107.

Figure 3D:
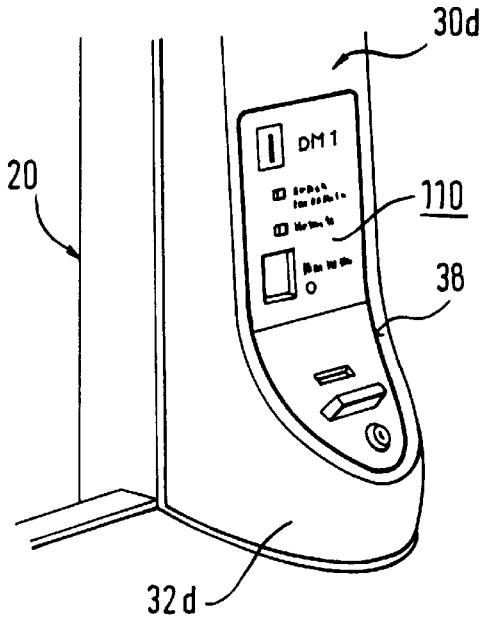
Figure 3E:
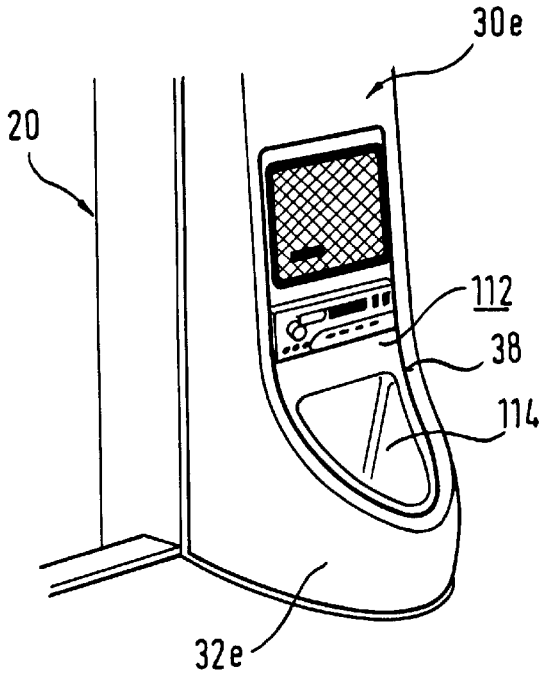
Figure 3F:
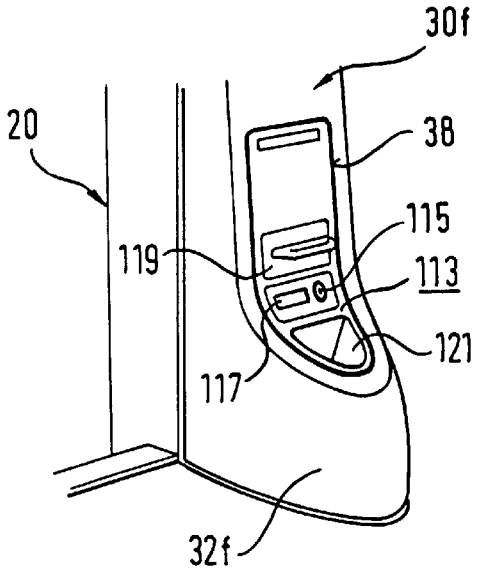

In FIG. 3*d* a functional unit 110 is inserted into the opening 38 which serves as so-called pay- and use unit. The forklift truck can be rented for a time by inserting a coin. In FIG. 3*e* a functional music unit 112 comprising a radio receiver, speaker and recorder is installed into the opening 38. Additionally, an opening 114 is spared for the accommodation of objects. In FIG. 3*f* a standard unit 113 is inserted into the opening 114. It includes an ignition lock 115, a display 117 as well as a drawer 119, for instance an ashtray or suchlike. In the lower wider portion 32*f* an opening 121 pointing upwardly is spared for the accommodation of any objects.

It appears that the covering 30*a* to 30*e* for the monomast 20 is always identical in construction but receives different functional units. The user, therefore, can choose which functional unit he wants when ordering the forklift truck with the manufacturer. In addition, it is also possible to choose for the covering a different design so as to use it for promotional or other purposes.

Figure 4:
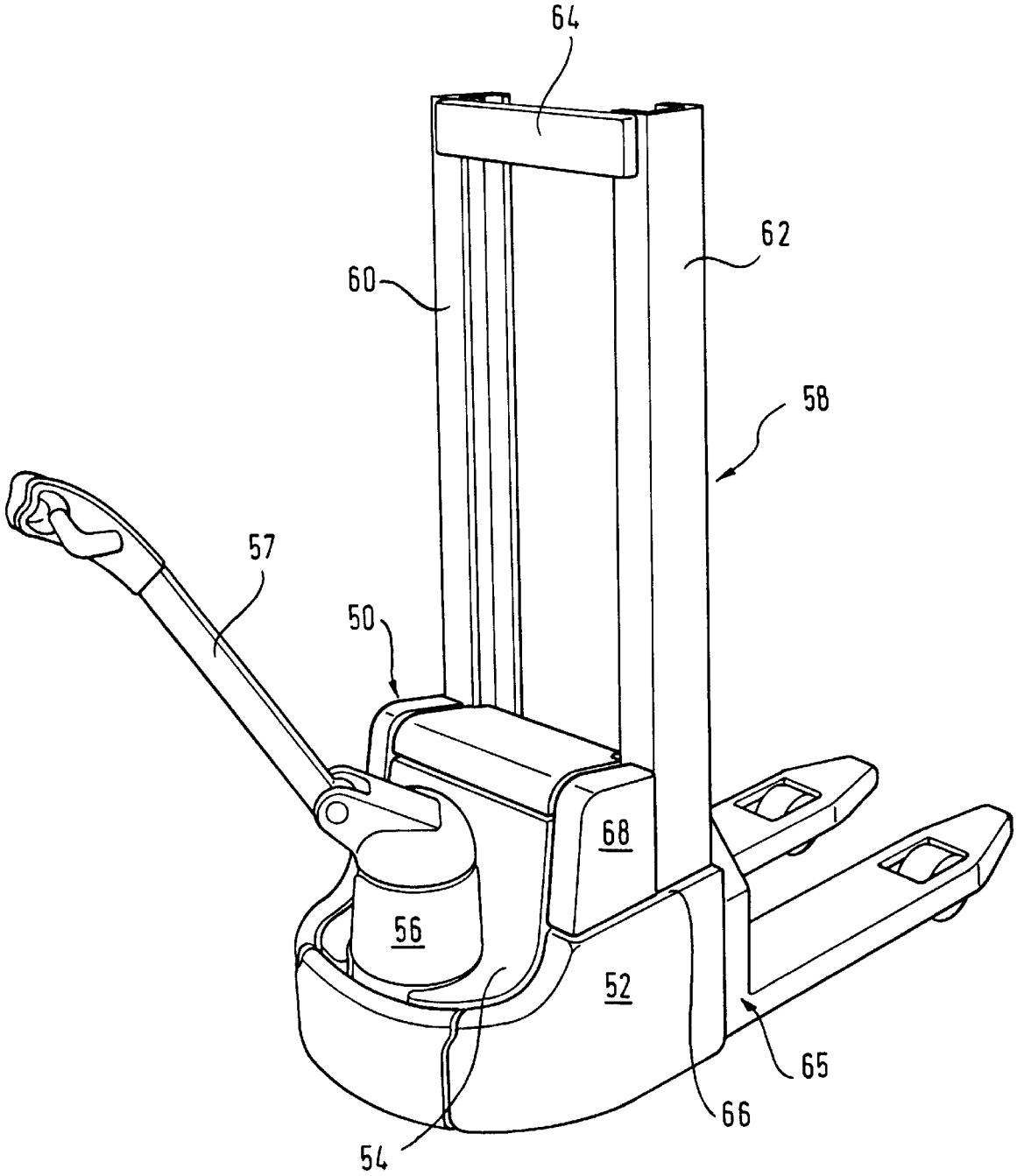
FIG. 4 perspectively shows a forklift truck comprising a lifting means being composed of two sections which is the basic model for further embodiments according to the invention.

The forklift truck according to FIG. 4 comprises a driving means 50 which is surrounded by a housing 52. In the area of a rounded shoulder 54 a driving motor 56 is centrally arranged on a stand which is mounted pivotally about a vertical axis, as known for shaft-guided forklift trucks per se. A shaft 57 is coupled to a driving motor about a horizontal axis in a conventional way. In the front area of the driving means a lifting means 58 is arranged comprising two mast sections 60, 62 spaced in transverse direction which at the upper end are connected by means of a cross arm.

A cargo carriage 64 is guided by the lifting means 58 at variable height, as also known per se.

As appears, a shoulder 66 is provided at the side of the covering or the driving means or the housing 52 (needless to say that a shoulder is also provided on the opposite side of the housing). A covering portion 68 arranged above said shoulder 66 compactly terminates with the outer surface of the mast section 62.

The basic model shown in FIG. 4 always appears again in the description of the following FIGS. 5 to 12, for which reason the components shown in FIG. 4 are provided with identical reference numbers in FIGS. 5 to 12.

Figure 5:
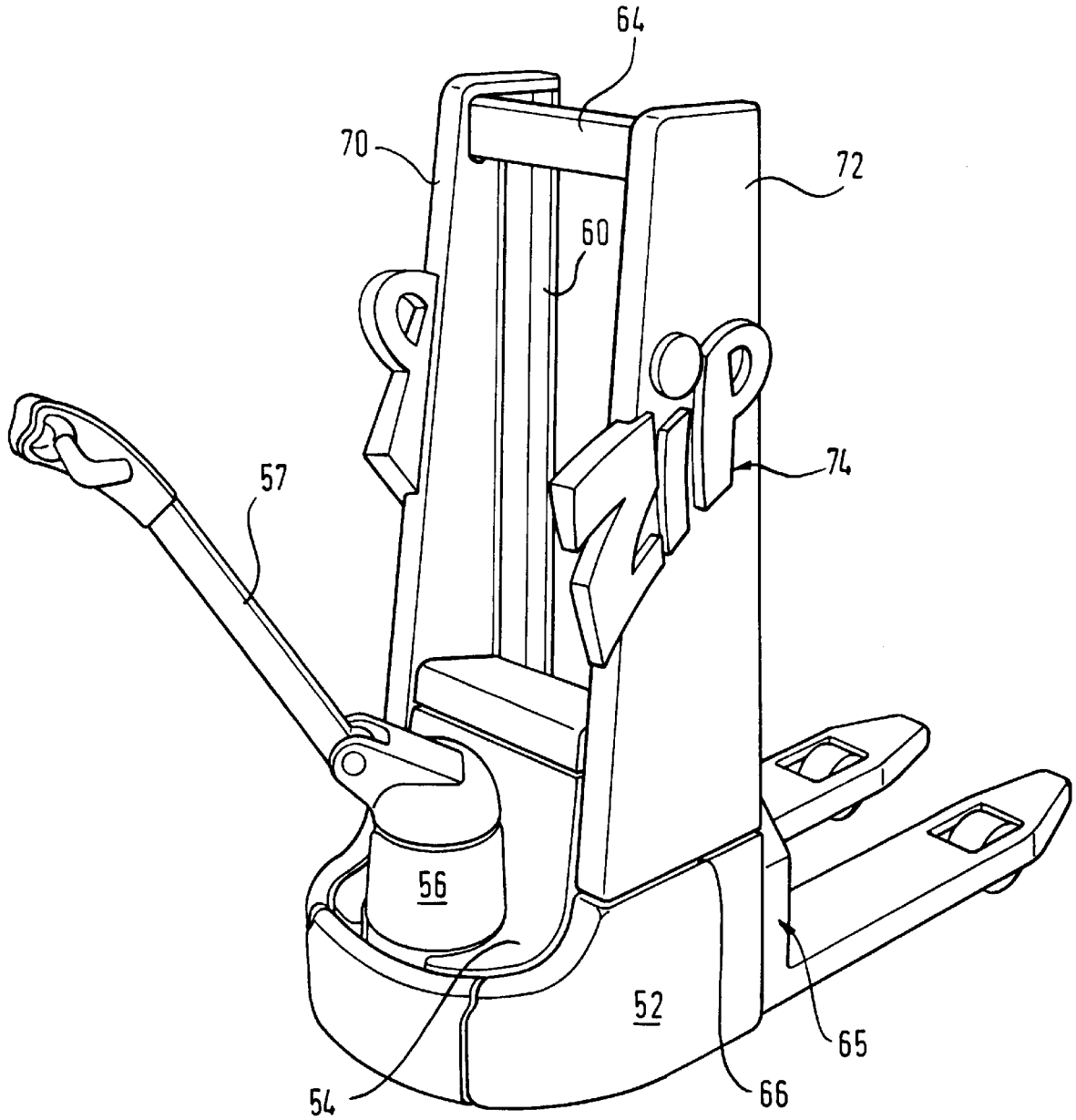
FIG. 5 shows the forklift truck according to FIG. 4 including a first embodiment of a covering.

In FIG. 5, at the outer surfaces of the mast sections 60, 62, box-type coverings 70, 72 are arranged, the large-surface outer surface of which is trapezoidal, i.e. tapers upwardly. Looking at them in direction of motion they are more narrow and have a constant width. The coverings 70, 72 adjoin the shoulders 66 and can also rest on them. The outer surface of the coverings 70, 72 compactly terminates with the outer surface of the housing 52 in this area. The coverings 70, 72 which may consist of sheet metal or a suitable synthetic material may be detachably fixed to the mast sections 60, 62, for instance by clipping them on the latter or so. They serve as advertising medium and may be provided with an advertising print or a relief-like embossing, as shown at 74, for showing or describing an object to be promoted, for instance. As can be seen, especially in the lower portion the width of the outer surface of the coverings 70, 72 is substantially larger than the width of the mast sections 60, 62. As shown, the lower portion of the coverings 70, 72 is integrated into the housing 52.

Figure 6:
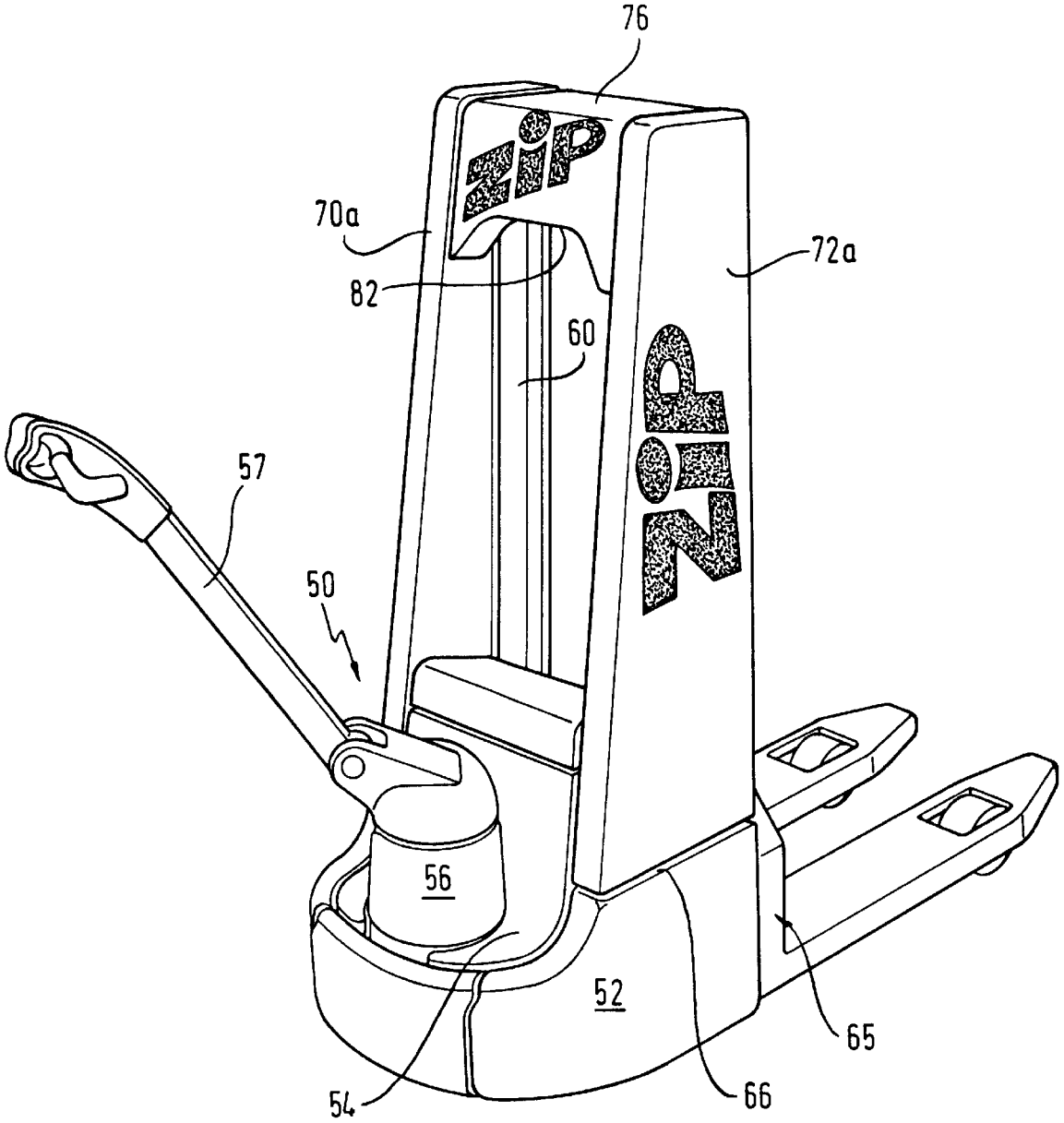
FIG. 6 shows the forklift truck according to FIG. 4 including a second embodiment of a covering.

In FIG. 6 coverings 70*a*, 72*a* are secured to the vehicle according to FIG. 4. With respect to structure and arrangement they are similar to coverings 70, 72 according to FIG. 5 so that it is not necessary to enter into details any more. As can be seen from FIG. 6, however, an additional covering 76 is provided in the upper area between coverings 70*a*, 72*a*. It covers the upper portion between the coverings 70*a*, 72*a* vertically as well as horizontally. The covering 76 is suitable as an advertising medium as well. As appears, it approximately compactly terminates with the associated surfaces of coverings 70*a*, 72*a*.

Figure 7:
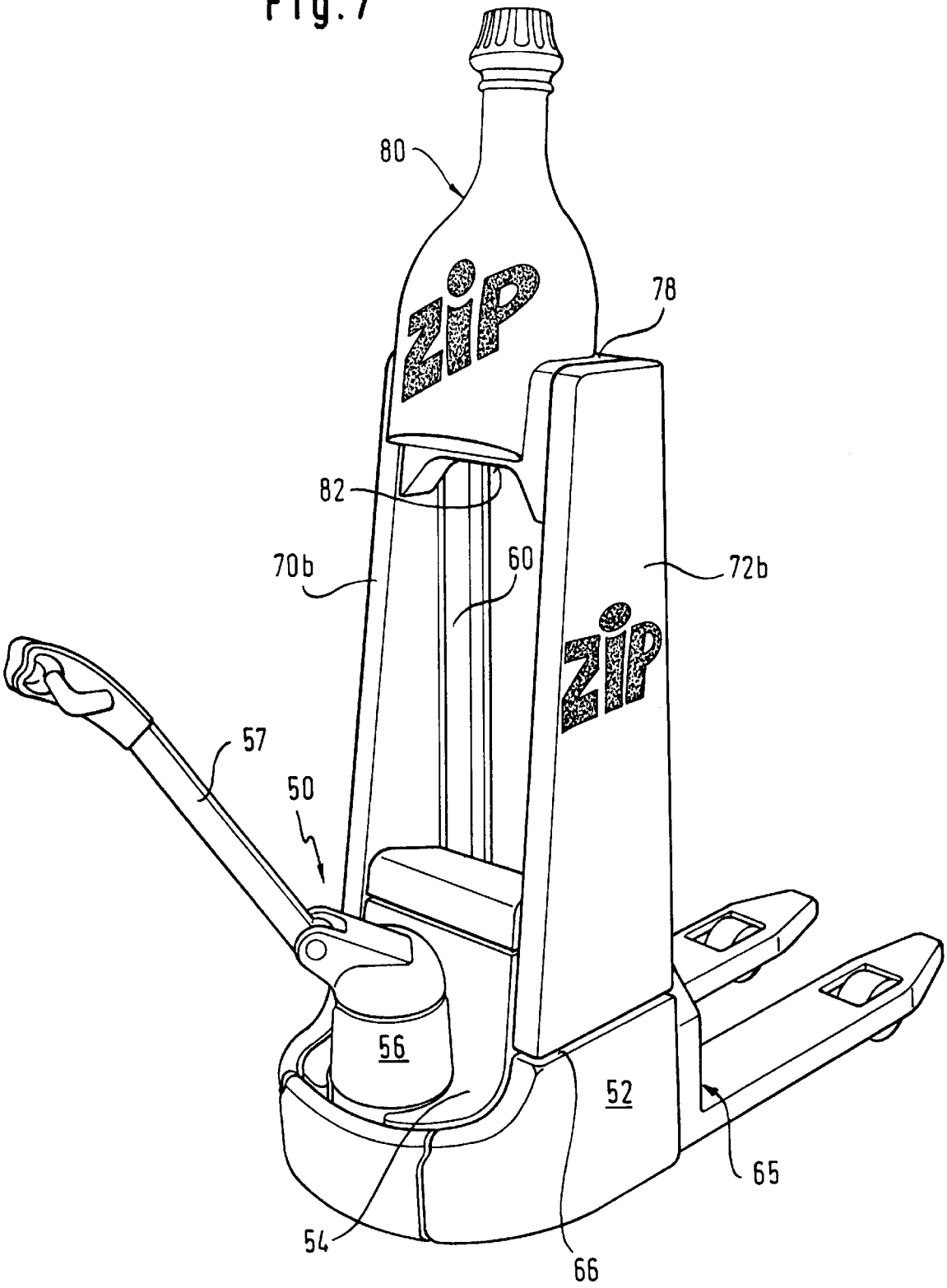
FIG. 7 shows the forklift truck according to FIG. 4 including a third embodiment of a covering.

In FIG. 7 coverings 70*b*, 72*b* are provided which are similar to coverings 70*a*, 72*a* according to FIG. 6. At the upper end between the coverings 70*b*, 72*b* a further covering 78 is provided which partly is comparable to covering 76 according to FIG. 6 but which, additionally, comprises the upper end of a bottle 80 or is formed so as to be one piece therewith. In both cases, the covering 76 or 78 is provided with an upwardly extending recess 82 so as to largely allow an unlimited view of the area between the mast sections 60, 62.

Figure 8:
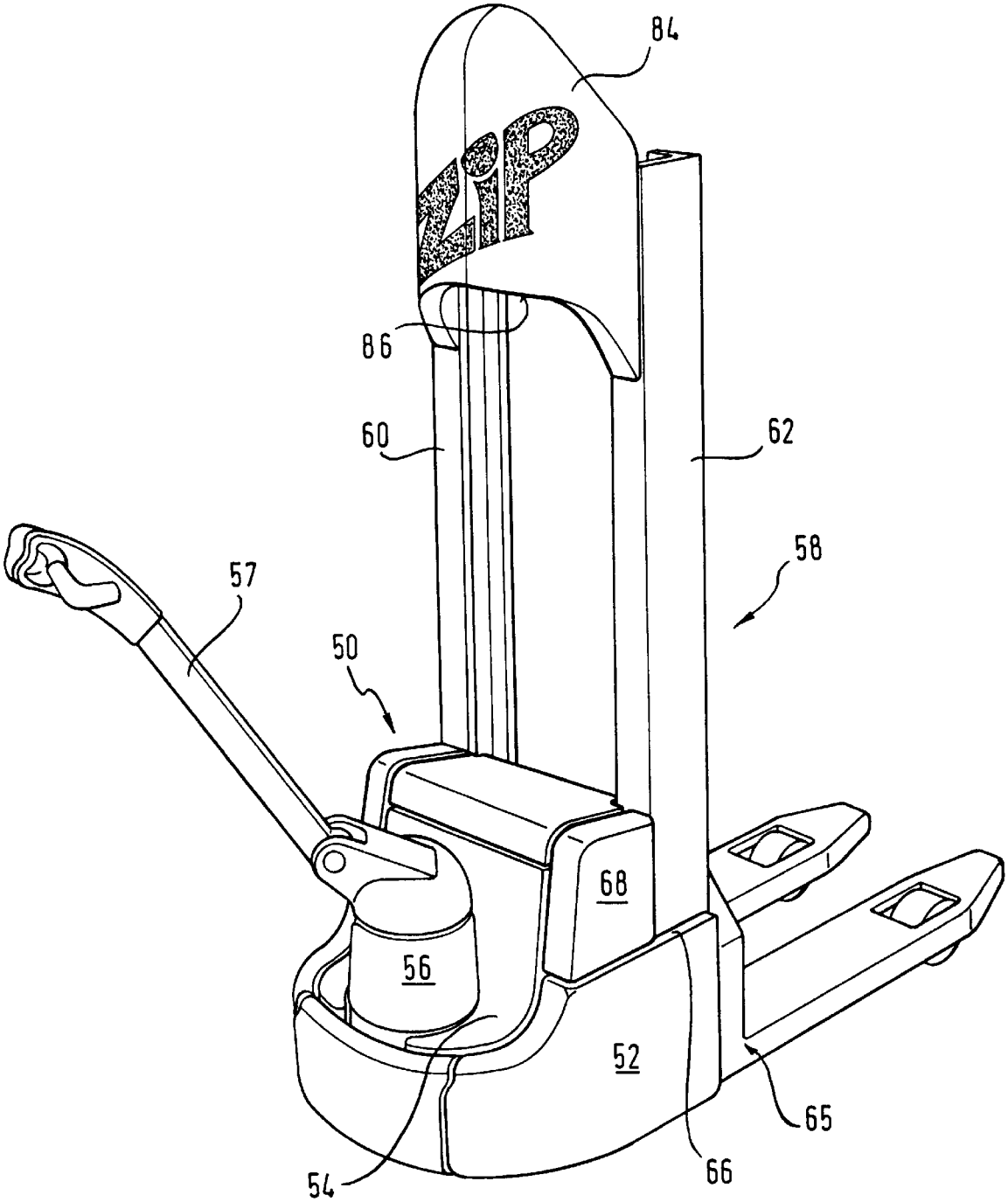
FIG. 8 shows the forklift truck according to FIG. 4 including a fourth embodiment of a covering.

In FIG. 8 a portion 84 which is curved towards the driving means is arranged in the upper area of that side of the mast sections 60, 62 facing the shaft 57 which portion tapers upwardly and is spared below at 86. As can be seen, said portion 84 serves as an advertising medium as well. It may be detachably connected to the mast sections 60, 62 in a suitable way.

Figure 9:
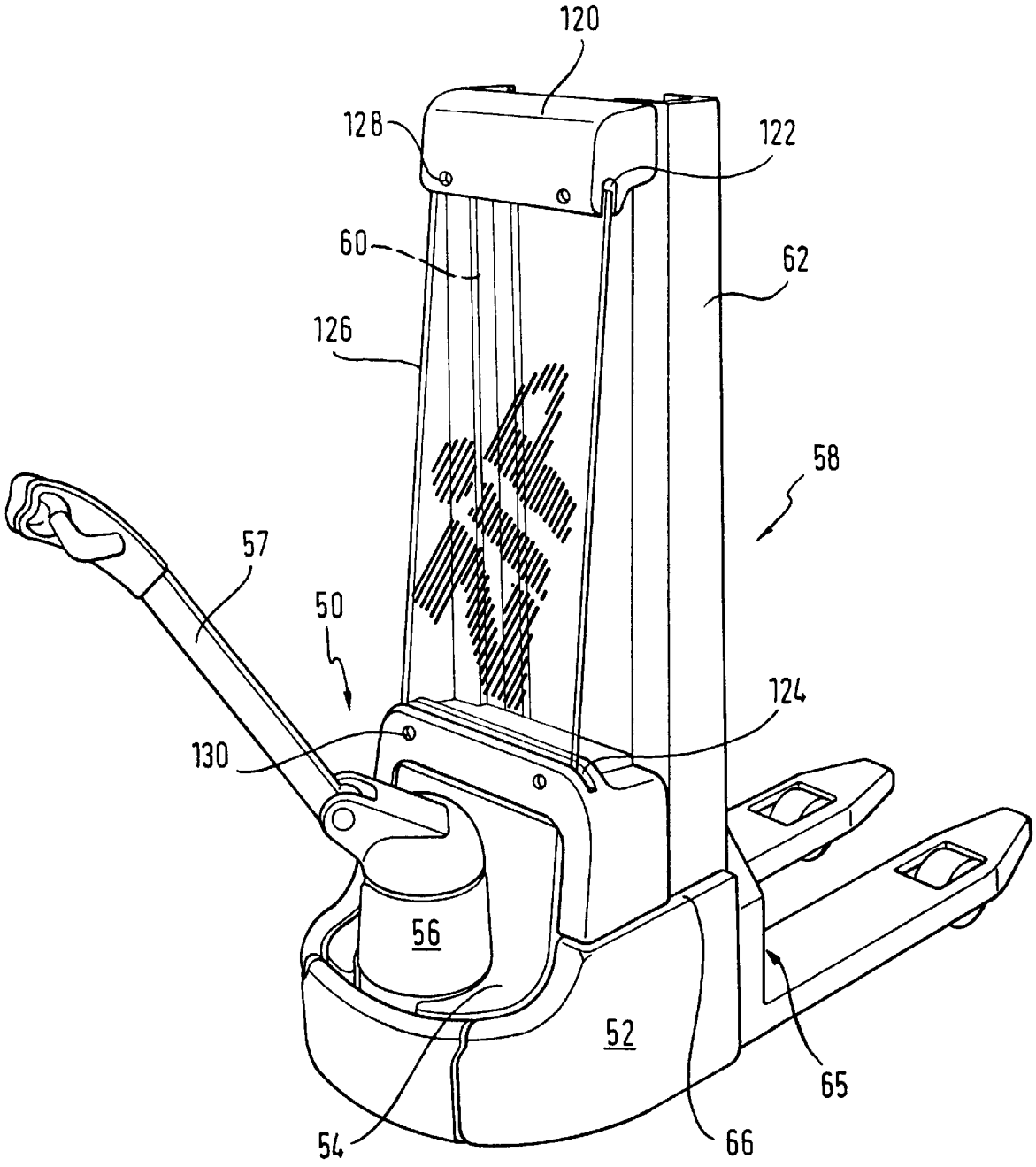
FIG. 9 shows the forklift truck according to FIG. 4 including a fifth embodiment of a covering.

According to the embodiment of FIG. 9, a box-type fixing means 120 is arranged on the cross arm 64 towards the driving means which fixing means includes a transversely extending aperture 122 pointing approximately downwardly. The housing 52 of the driving means 50 also comprises an aperture 124 on its upper surface. Into said apertures 122, 124 a plate 126 of glass or transparent synthetic material may be inserted. It may be secured to the fixing means 120 and within the aperture 124 with the aid of screws or suchlike which are inserted into holes 128 or 130. The plate 126 which extends slightly obliquely downwardly approximately covers the space between the mast sections 60, 62. Plate 126 may be printed, lettered or provided with an advertising print or suchlike in another way which, however, enables the operator of the vehicle to still have a sufficient view. Plate 126, however, may also be removed if not needed.

Figure 10:
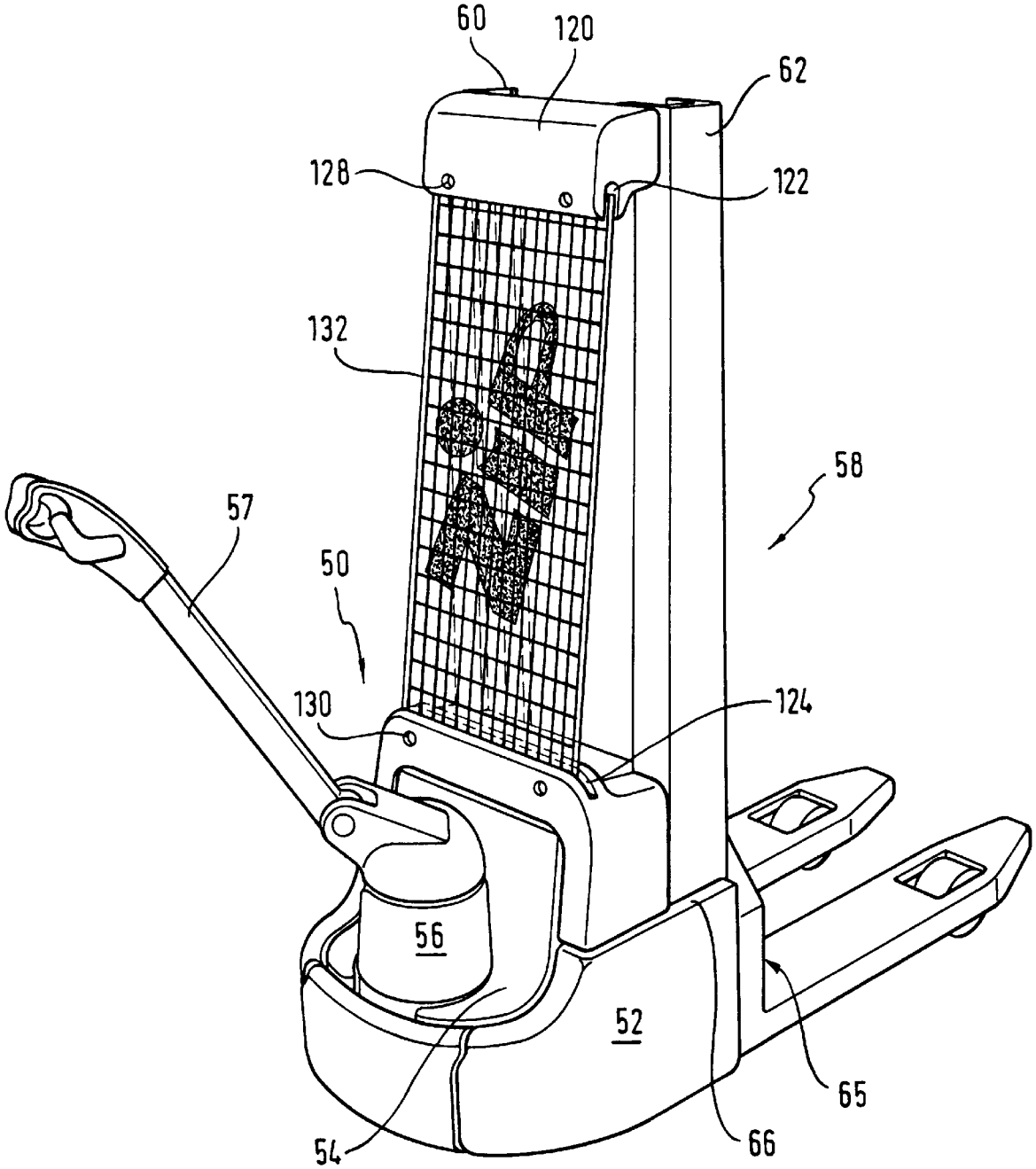
FIG. 10 shows the forklift truck according to FIG. 4 including a sixth embodiment of a covering.

The vehicle according to FIG. 10 is comparable to that according to FIG. 9 and thus also comprises a fixing means 120 and the aperture 124 in the housing. Into said apertures 122, 124 a lattice 132 is inserted which is similar to that of FIG. 9 in structure and the size of plate 126. As can be seen, the lattice 132 may serve as an advertising medium as well.

Figure 11:
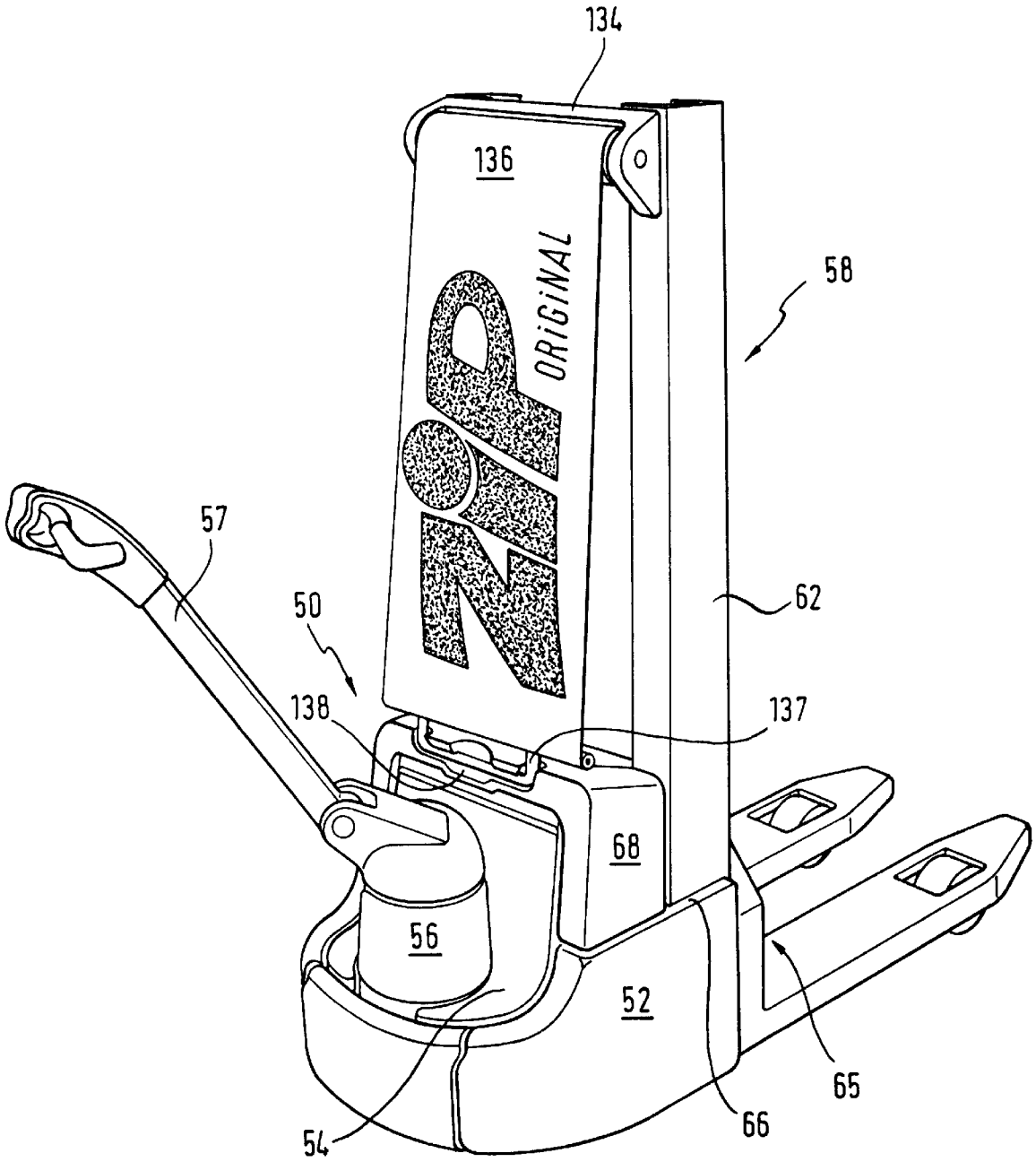
FIG. 11 shows the forklift truck according to FIG. 4 including a seventh embodiment of a covering.

In FIG. 11 at the upper end of that side of the mast sections 60, 62 facing the driving means 50 a fixing means 134 for a window shade 136 is arranged. Said fixing means 134 may be provided instead of the traverse 64 according to FIG. 4 or be attached to the latter. At the upper end the window shade is provided with a bow-type member 136 which is embedded in a recess 138 on the upper surface of the housing 52 and may be kept therein. The window shade 136 may be moved upwardly if not needed any more. The size and the arrangement of the window shade 136, in return, correspond to the plate 126 according to FIG. 9, or to the lattice 132 according to FIG. 10.

Figure 12:
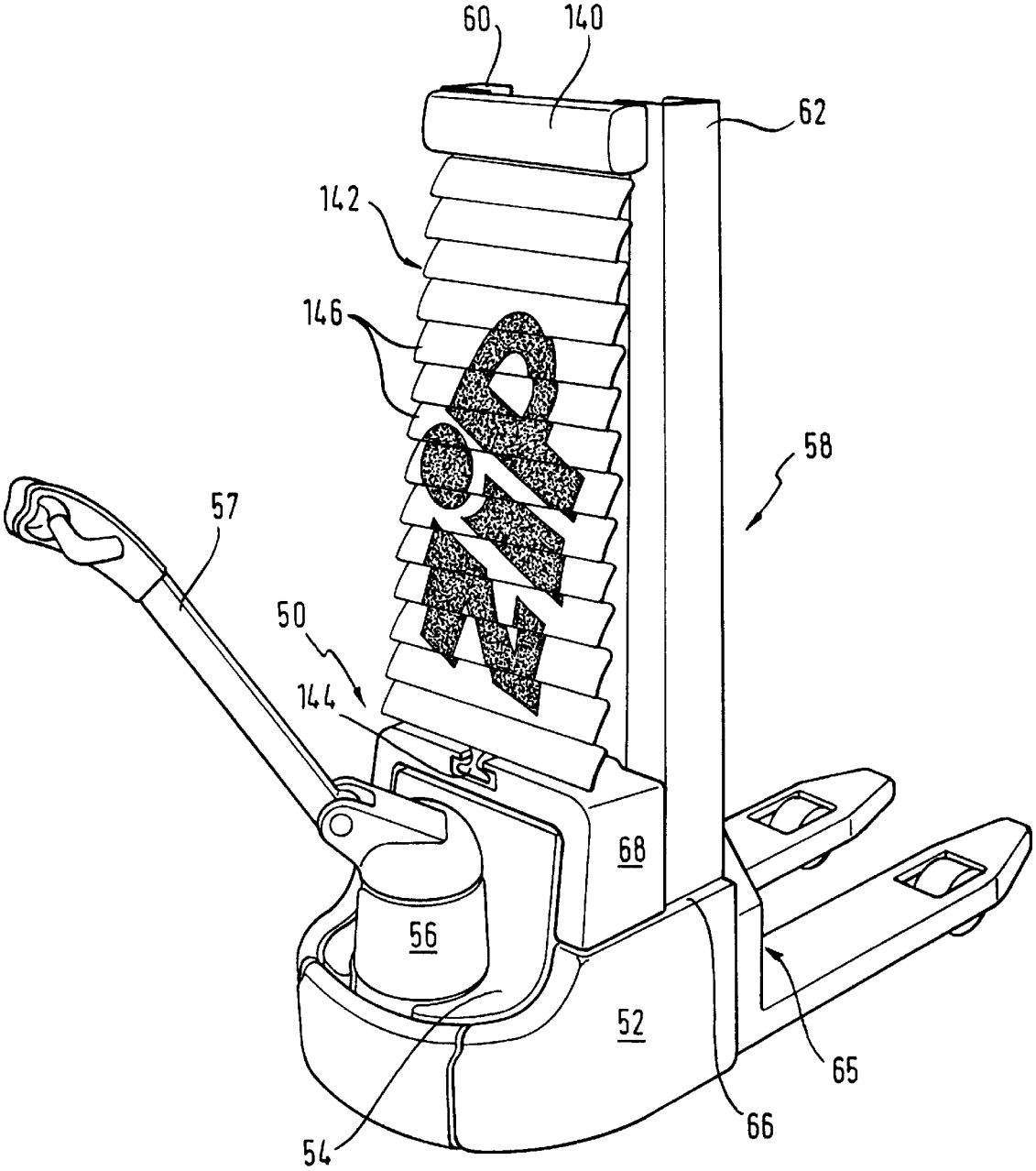
FIG. 12 shows the forklift truck according to FIG. 4 including an eighth embodiment of a covering.

According to the embodiment of FIG. 12, on the side of the mast sections 60, 62 facing the driving means 50 a fixing means 140 for a jalousie 142 is arranged which, as can be seen, at its lower end is provided with a bow-type member 144 for fixing the jalousie 142 in the upper portion of the housing 52. The size and the arrangement of the jalousie are comparable to the window shade 136 according to FIG. 11. Any measures not shown may serve the purpose of moving the jalousie upwardly and into the fixing means 140 or close to the latter if intending to remove said jalousie from the space between the mast sections 60, 62. However, it is also possible to put all slats 146 of the jalousie 142 horizontally for allowing a look through the latter. Both the window shade 136 according to FIG. 11 and the jalousie 142 according to FIG. 12 may serve as a medium for advertising.

Figure 13:
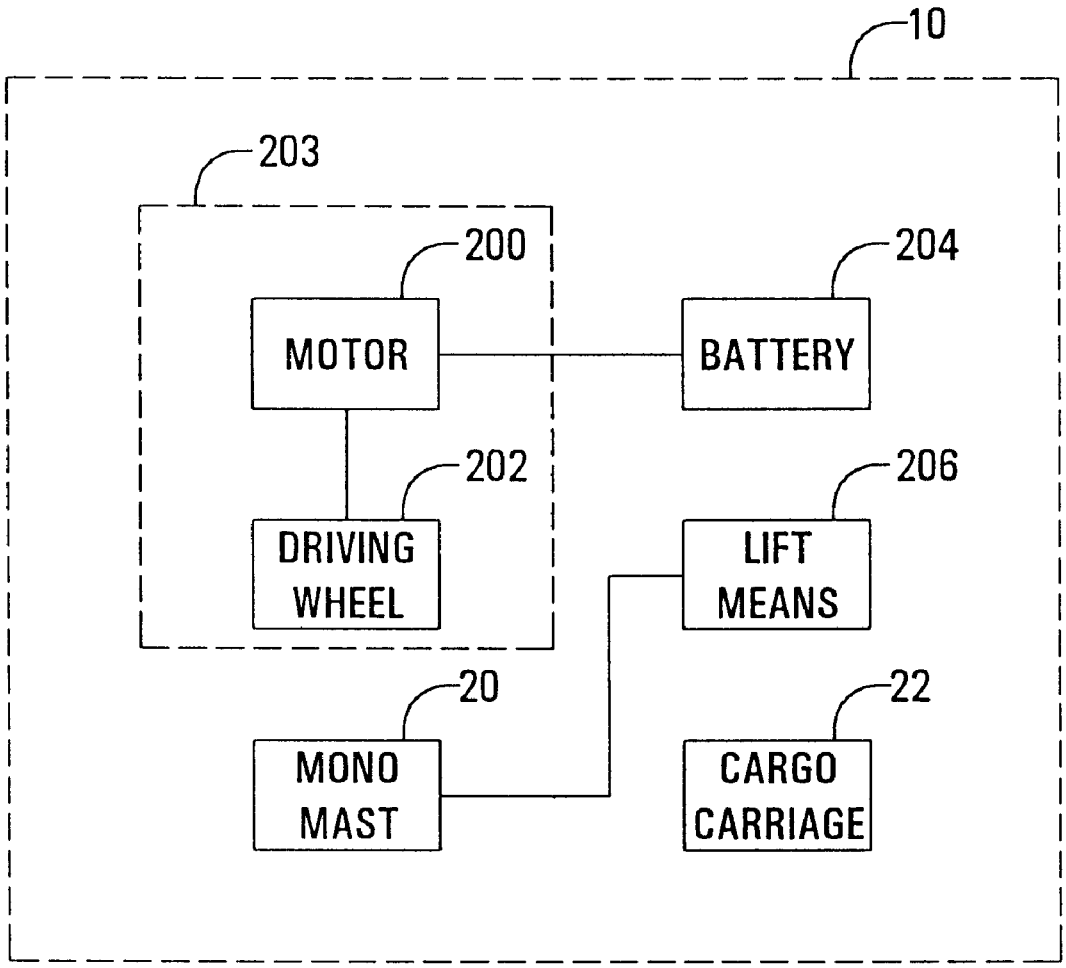
FIG. 13 shows a block diagram of the components inside the chassis 10.

FIG. 13 shows a block diagram of the components in the chassis 10, all of which are well known in the prior art. An electric motor 200 drives drive wheel 202 and is powered by battery 204, as is well known in the art. A hydraulic lift 206 is attached to a cargo carriage 22, the hydraulic lift lifting the cargo carriage up and down on monomast 20, as is well known in the art. The motor 200 and driving wheel 202 are arranged on a stand 203 which is mounted rotatably about a vertical axis, as is well known in the art.

What is claimed is:

1. A forklift truck comprising:

a chassis (10) including a housing (12);

two parallel spaced wheel arms attached to said chassis, said housing including a battery-operated driving motor as well as a hydraulic lift;

a pole (16) including control means for the control of said motor and said hydraulic lift;

a driving wheel (202) supported in a stand (203), said stand being rotatably supported about a vertical axis, said stand supporting said motor and said pole being linked to said stand;

a monomast (20) arranged centrally between said wheel arms integrally with said housing, the monomast have front and back sides, the back side facing the pole;

a cargo carriage (22) to be moved by said hydraulic lift along said monomast;

a box-shaped cover attached to the back side of the monomast;

the pole being arranged asymmetrically with respect to said monomast.

2. The forklift truck according to claim 1, characterized in that an advertising medium comprises at least part of said hydraulic lift.

3. The forklift truck according to claim 1, characterized in that said monomast (20) is integrated into the housing (12) of chassis (10) and only slightly projects beyond an outer contour of the housing.

* * * * *